US008253647B2

(12) United States Patent
Le et al.

(10) Patent No.: US 8,253,647 B2
(45) Date of Patent: Aug. 28, 2012

(54) HIGH ISOLATION MULTI-BAND MONOPOLE ANTENNA FOR MIMO SYSTEMS

(75) Inventors: Kevin Le, Bloomingdale, IL (US); Jesse Lin, Carol Stream, IL (US)

(73) Assignee: PC-Tel, Inc., Bloomingdale, IL (US)

( * ) Notice: Subject to any disclaimer, the term of this patent is extended or adjusted under 35 U.S.C. 154(b) by 341 days.

(21) Appl. No.: 12/701,778

(22) Filed: Feb. 8, 2010

(65) Prior Publication Data

US 2010/0220034 A1 Sep. 2, 2010

Related U.S. Application Data

(60) Provisional application No. 61/156,179, filed on Feb. 27, 2009.

(51) Int. Cl.
*H01Q 1/50* (2006.01)

(52) U.S. Cl. ..... 343/906; 343/702; 343/850

(58) Field of Classification Search ..... 343/906, 343/702, 850

See application file for complete search history.

(56) References Cited

U.S. PATENT DOCUMENTS

| | | | | |
|---|---|---|---|---|
| 5,440,317 | A | 8/1995 | Jalloul et al. | |
| 5,949,383 | A * | 9/1999 | Hayes et al. | 343/795 |
| 6,329,954 | B1 * | 12/2001 | Fuchs et al. | 343/725 |
| 6,806,838 | B2 * | 10/2004 | Petros et al. | 343/725 |
| 2008/0079641 | A1 * | 4/2008 | Grunig et al. | 343/702 |
| 2008/0117111 | A1 | 5/2008 | Ikeda et al. | |

FOREIGN PATENT DOCUMENTS

| | | |
|---|---|---|
| DE | 20 2006 012 198 U1 | 10/2006 |
| JP | 2003-8333 | 1/2003 |
| WO | WO 2006/059393 A1 | 6/2006 |

OTHER PUBLICATIONS

European Search Report corresponding to Application No. EP 10 15 3723.

English language translation of abstract of Publication No. DE202006012198 (U1).

English language translation of abstract of Japanese Publication No. 2003008333.

* cited by examiner

*Primary Examiner* — Hoanganh Le

(74) *Attorney, Agent, or Firm* — Husch Blackwell LLP

(57) ABSTRACT

A high isolation multi-band monopole antenna that can be used in connection with MIMO systems is provided. The antenna can include various components to prevent band to band coupling and provide isolation from neighboring antennas.

20 Claims, 20 Drawing Sheets

HIGH ISOLATION MULTI-BAND MONOPOLE ANTENNA FOR MIMO SYSTEMS

CROSS-REFERENCE TO RELATED APPLICATIONS

This application claims priority to U.S. Provisional Patent Application No. 61/156,179 filed Feb. 27, 2009 titled "High Isolation Multi-band Monopole Antennas for MIMO Systems." U.S. Application No. 61/156,179 is hereby incorporated by reference.

FIELD OF INVENTION

The present invention relates generally to antennas. More particularly, the present invention relates to high isolation multi-band monopole antennas that can be used in connection with a multiple input and multiple output (MIMO) system.

BACKGROUND

In known MIMO systems, there is a desire to exploit the multi-path capabilities of the system to enhance the system capacity. One way to exploit the multi-path capabilities of a MIMO system is to incorporate multiple antennas or multi-band antennas at both the transmitter and receiver. That is, a transmitter sends multiple beams from multiple transmit antennas, and the beams are received by multiple receive antennas at a receiver.

It is desirable for the beams sent from the transmit antennas in a MIMO system to be wide. Accordingly, it has been necessary for known MIMO systems to include antennas or multi-band antennas spaced at a predetermined distance apart from one another. Such separation between the antennas prevents interference between the beams and prevents band-to-band coupling between beams from antennas operating at different frequencies.

However, due to space and size constraints, it may be desirable to place antennas of a MIMO system in close proximity to one another. For example, a base for the antennas may be of a limited size. In such a situation, it would be desirable to maintain the wide beam of the antennas while still preventing interference and band-to-band coupling between the antenna beams.

Known antennas placed within close proximity to one another in a MIMO system present several disadvantages. First, mutual surface radiation from the antennas can couple with each other. Additionally, when the antennas are elevated above a large ground reflector, a small antenna base can defocus the reflection of the main beam radiation. Finally, the low isolation between antennas can introduce signal interference.

Accordingly, there is a continuing, ongoing need for an antenna that can be used in connection with a MIMO system and placed within close proximity to a second antenna. Preferably, such an antenna is a high isolation multi-band monopole antenna.

DESCRIPTION OF THE PREFERRED EMBODIMENTS

Figure 1:
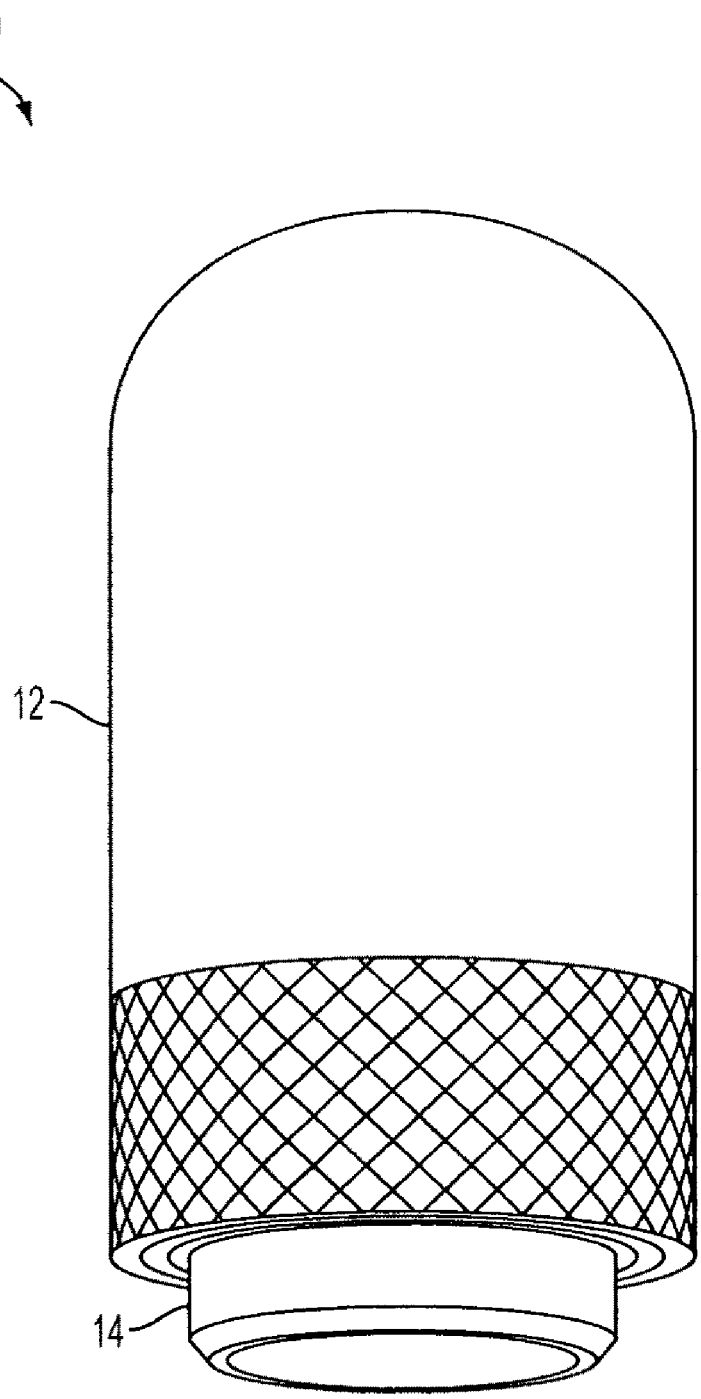
FIG. 1 is a side view of a high isolation monopole antenna in accordance with the present invention.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments of the present invention include an antenna that can be used in connection with a MIMO system and placed within close proximity to at least a second antenna. Preferably, an antenna in accordance with the present invention is a high isolation multi-band monopole antenna. In some embodiments of the present invention, a 40 dB isolation between multi-band antennas in a MIMO system can be achieved.

FIG. 1 is a side view of the exterior of a high isolation monopole antenna 10 in accordance with the present invention. As seen in FIG. 1, an antenna 10 in accordance with the present invention can include an upper domed portion 12 and a lower connection portion 14. The upper dome portion 12 can house various components of the antenna 10, which are discussed in further detail herein. A connector pin can extend from the inside of the upper dome portion 12 down to the lower connection portion 14. The lower connection portion 14 and an associated connector pin can connect to an antenna base hub as would be known by those of skill in the art.

It is desirable for the antenna 10, including the upper dome portion 12, to have a predetermined size. For example, the upper dome portion 12 must be large enough to house the various components of the antenna 10, but should be small enough to accommodate any space and size constraints of the surrounding area, including the antenna base hub.

Figure 2:
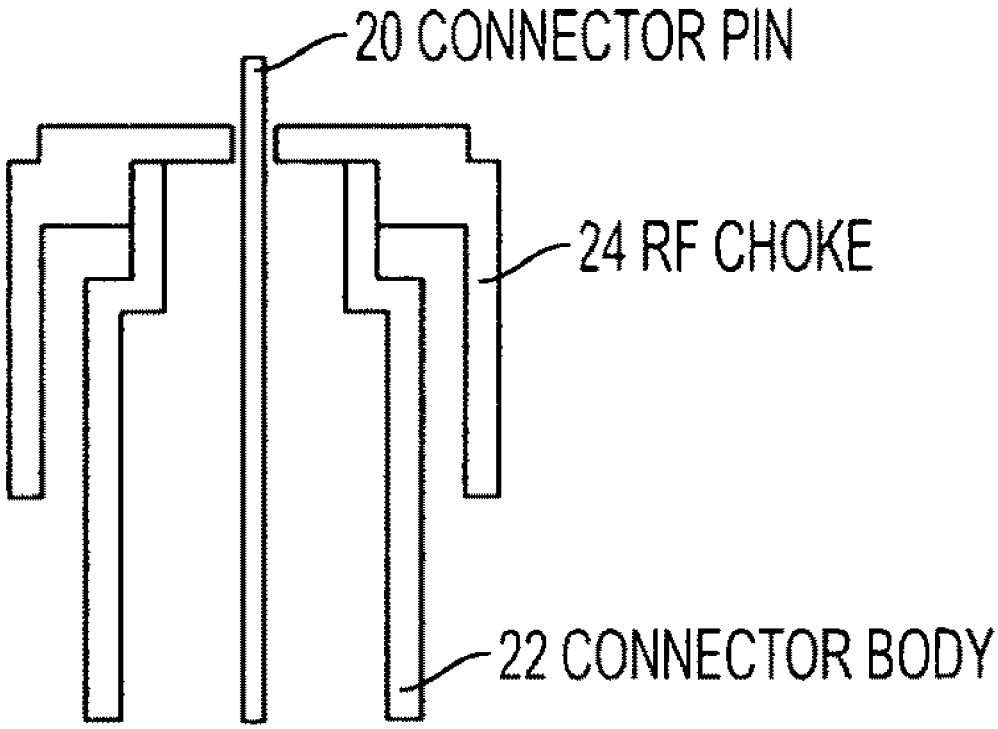
FIG. 2 is a schematic view of the components of an antenna in accordance with one embodiment of the present invention.

FIG. 2 is a schematic view of the components of an antenna in accordance with some embodiments of the present invention. As seen in FIG. 2, an antenna can include a connector pin 20, a connector body 22, and a radio frequency (RF) choke 24. The components seen in FIG. 2 can be supported by an antenna base (not shown).

The connector pin 20 can extend vertically along a central vertical axis of the antenna. The connector body 22 can be mounted on an electrical housing and extend in a vertical direction on both sides of the connector pin 20 so as to be substantially parallel with the connector pin 20.

Although not seen in FIG. 2, an insulation material can be located in the spaces between the connector pin 20 and the connector body 22 on each side of the connector pin 20. The insulation material can serve both mechanical and electrical purposes. For example, the insulation material can maintain the physical separation of the components shown in FIG. 2. The insulation material can also maintain a desired input impedance level.

The connector body 22 can emit an electric current in a vertical direction along the length of the connector pin 20 and in a circular wave form around the connector pin 20. The antenna components of FIG. 2 can be used in connection with an antenna that can be used in a MIMO system. Accordingly, the current emitted from the connector body 22 can excite a radiator as would be desirable for MIMO systems.

The current emitted from the connector body 22 can excite an antenna element to generate radiation, and in accordance with known principles of antennas, the radiation can scatter. The RF choke 24 can be integrated into the antenna base to prevent reflections of the beam scatter from interfering with the main beam emitted from the antenna element. That is, the RF choke 24 can prevent surface radiation from interfering with beam radiation. In embodiments of the present invention, the RF choke 24 can reduce reflection interference by approximately 25%.

When a first antenna containing the components of FIG. 2 is placed within a predetermined distance from at least a second antenna containing the components of FIG. 2, the RF choke 24 in each antenna can also prevent interference between the beam radiation of each antenna. Thus, in accordance with the present invention, interference between beams from neighboring antennas can be reduced and/or substantially eliminated without narrowing the antennas' beams.

Figure 3:
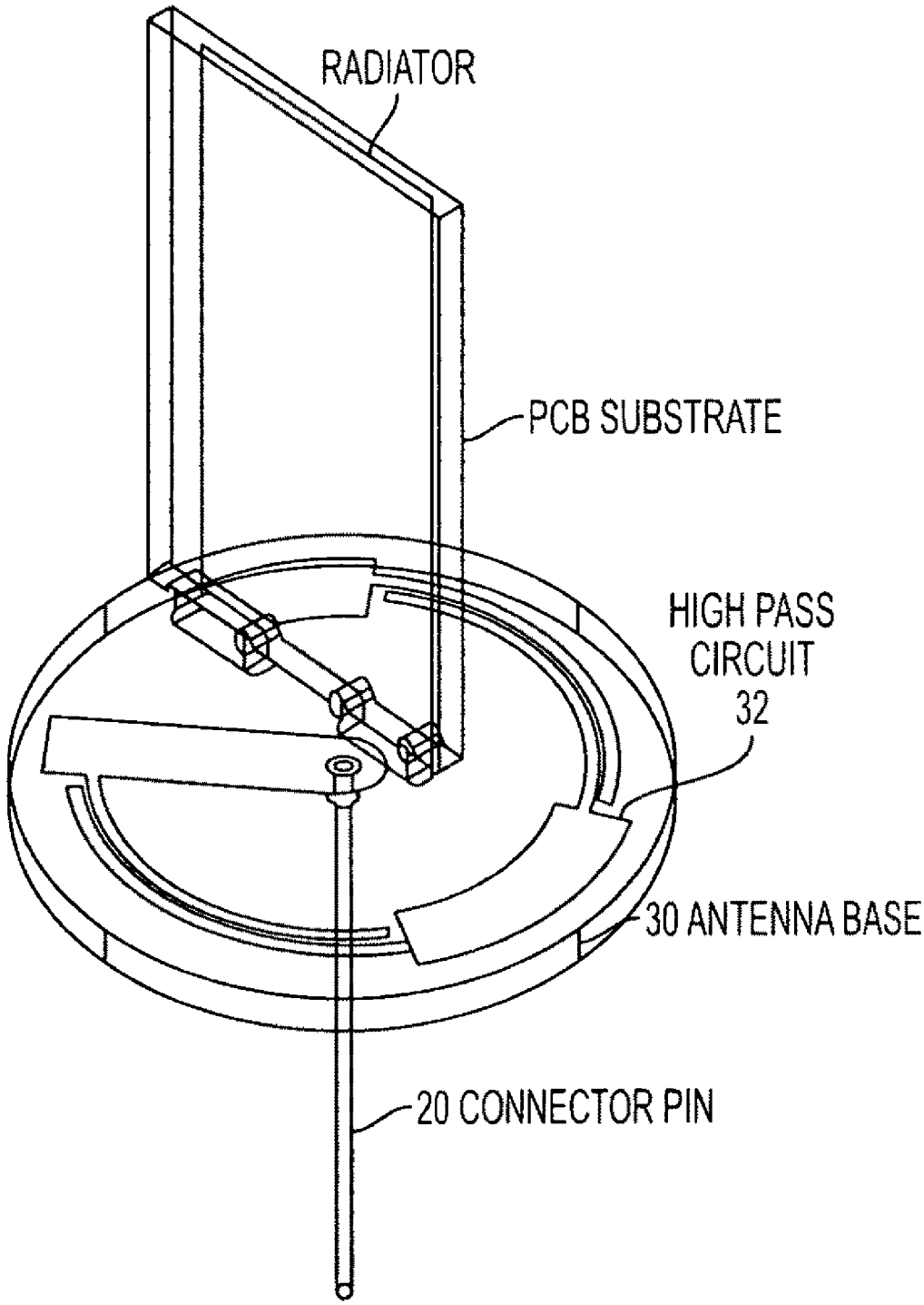
FIG. 3 is a schematic view of the components of an antenna in accordance with one embodiment of the present invention.

FIG. 3 is a schematic view of the components of an antenna in accordance with some embodiments of the present invention. As seen in FIG. 3, an antenna base 30 can include a high pass circuit 32 deposited thereon. A connector pin 20 can extend from the antenna base 30 for connecting to a base hub as would be known by those of skill in the art. The antenna base 30 can also support a printed circuit board (PCB) substrate 34 with a radiator 36 deposited thereon.

In accordance with the present invention, the high pass circuit 32 only allows a beam having at least a predetermined frequency to pass and be transmitted by the radiator 36. In embodiments of the present invention, the high pass circuit 32 only allows a beam having at least a 5 GHz frequency to pass. Thus, beams with a frequency lower than 5 GHz are prevented from being transmitted by the radiator 36.

When a first antenna containing the components of FIG. 3 and operating at a high frequency is placed within a predetermined distance from at least a second antenna operating at a low frequency, the high pass circuit 32 of the first antenna can prevent interference between the beam of the high frequency first antenna and the beam of the low frequency second antenna. Thus, in accordance with the present invention, band-to-band coupling can be reduced and/or substantially eliminated without affecting the antennas' beams.

Figure 4B:
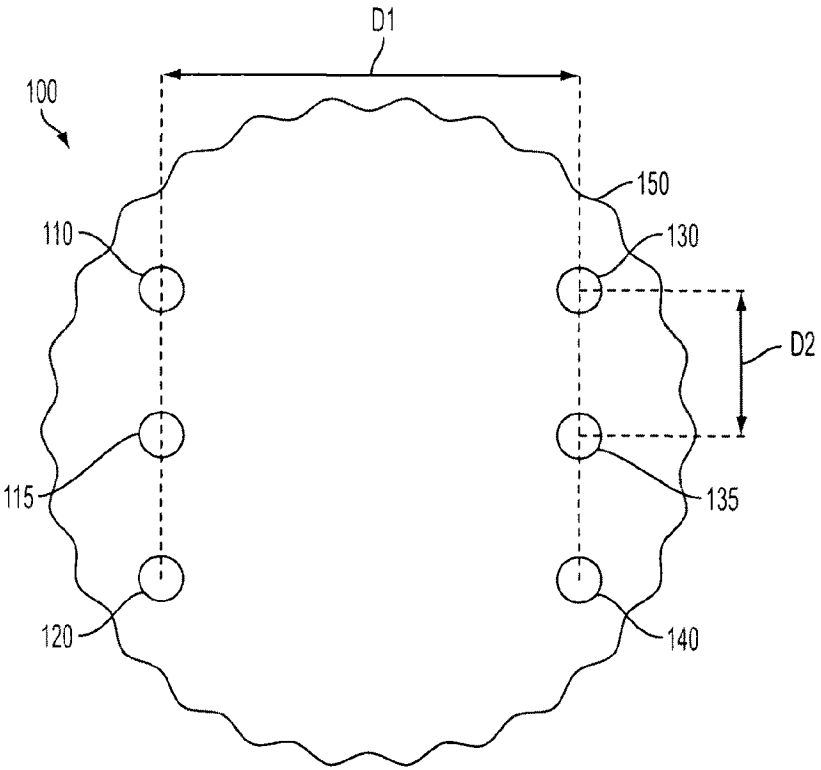
FIG. 4B is a top view of a plurality of antennas mounted on an antenna base hub in accordance with the present invention.
Figure 4C:
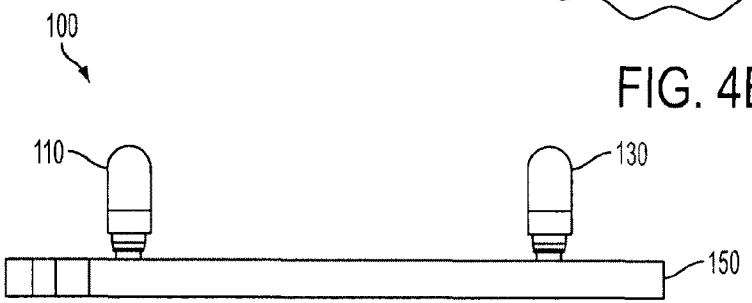
FIG. 4C is a side view of a plurality of antennas mounted on an antenna base hub in accordance with the present invention.
Figure 4A:
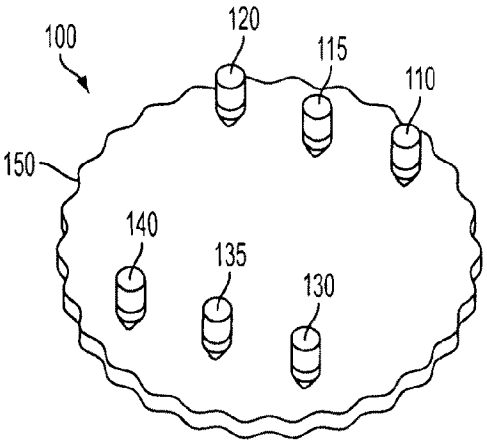
FIG. 4A is a perspective view of a plurality of antennas mounted on an antenna base hub in accordance with the present invention.

An antenna 10 as seen in FIG. 1 can include the components seen and described in connection with FIG. 2 and/or the components seen and described in connection with FIG. 3. Further, an antenna 10 can be mounted on an antenna base hub as would be known by one of ordinary skill in the art. FIG. 4A is a perspective view of a plurality of antennas 100 mounted on an antenna base hub 150 in accordance with the present invention, FIG. 4B is a top view of the plurality of antennas mounted on the base hub 150, and FIG. 4C is a side view of the plurality of antennas mounted on the base hub 150.

The base hub 150 can have an arbitrary footprint. In some embodiments of the present invention, the length and width of the base 150 can be predetermined by a system carrier. It is to be understood that the antenna base hub 150 as shown and described herein is not a limitation of the present invention.

In some embodiments, the top side of the base can include a flat surface. In other embodiments, the top side of the base 150 can include a curvature such that exterior portions of the base have a lower height than a central portion. In embodiments of the present invention, high isolation between the beams of multi-band monopole antennas mounted on the base hub 150 can be achieved to prevent interference between the antenna beams.

In embodiments of the present invention, the plurality of antennas 100 can include six antennas 110, 115, 120, 130, 135 and 140. In further embodiments, at least some of the antennas, for example 110, 115, and 120, can operate a low frequency, and at least some of the antennas, for example, 130, 135, and 140, can operate at a high frequency. In still further embodiments, antennas 110, 115, and 120 can operate at a frequency of approximately 2.4 GHz, and antennas 130, 135, and 140 can operate at a frequency of approximately 5 GHz.

The low frequency antennas 110, 115, and 120 can be placed and connected to one side of the base hub 150 at a left side port, mid-port, and right side port, respectively. Similarly, the high frequency antennas 130, 135, and 140 can be placed and connected to the opposite side of the base hub 150 at a left side port, mid-port, and right side port, respectively. It is to be understood that the number and placement of antennas in the plurality, and the number and placement of antennas operating in different bandwidths are not limitations of the present invention. For example, the number of antennas in each band can be more than shown and described herein to increase the operational capacity of the system.

The distance D1 from the center of one low frequency antenna to the center of the high frequency located directly across from the one low frequency antenna can vary depending on the level of desired isolation. Similarly, the distance D2 from the center of one antenna to the center of a neighboring antenna can vary depending on the level of desired isolation. In some embodiments, the distance D1 can be from about 5 inches to about 10 inches. In further embodiments, the distance D1 can be from approximately 7 inches to approximately 8 inches, and in still further embodiments the distance D1 can be approximately 7.1 inches. In some embodiments, the distance D2 can be from approximately 1 inch to approximately 5 inches. In further embodiments, the distance D2 can be from approximately 2 inches to approximately 3 inches, and in still further embodiments, the distance D2 can be approximately 2.4 inches.

The plurality of antennas 100 and base hub 150 can be part of a MIMO system. That is, the plurality of antennas 100 can both transmit and receive. In accordance with principles of MIMO systems, the beams transmitted from each antenna can pass through a matrix channel with good channel isolation, and multiple channels can be synchronized in phase and sampling alignment.

Figure 5:
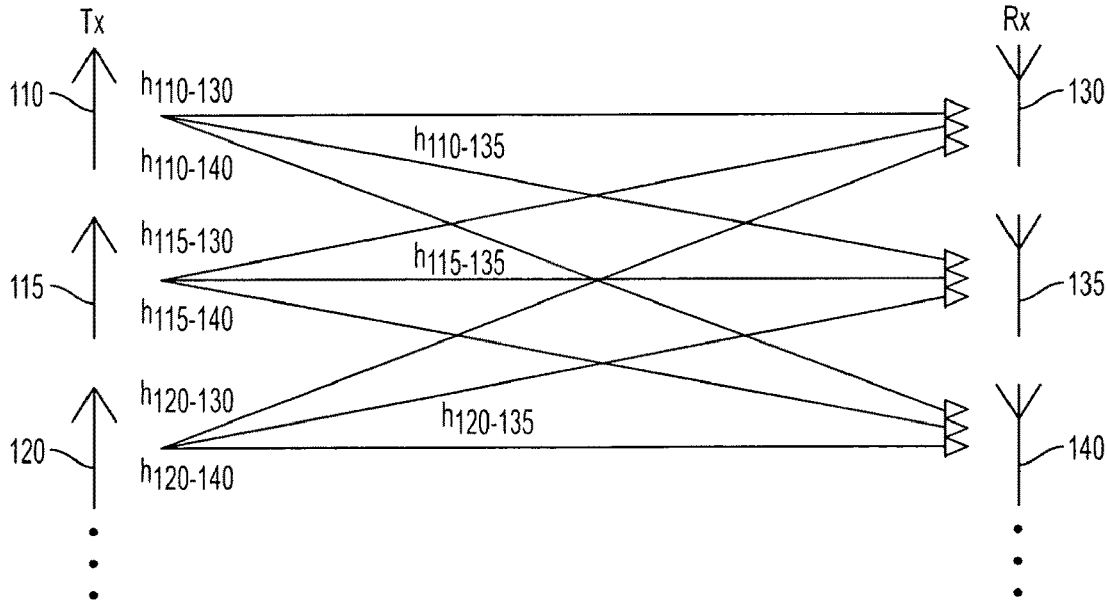
FIG. 5 is a schematic diagram of the channels on which a plurality of antennas transmit in accordance with the present invention.
Figure 6A:
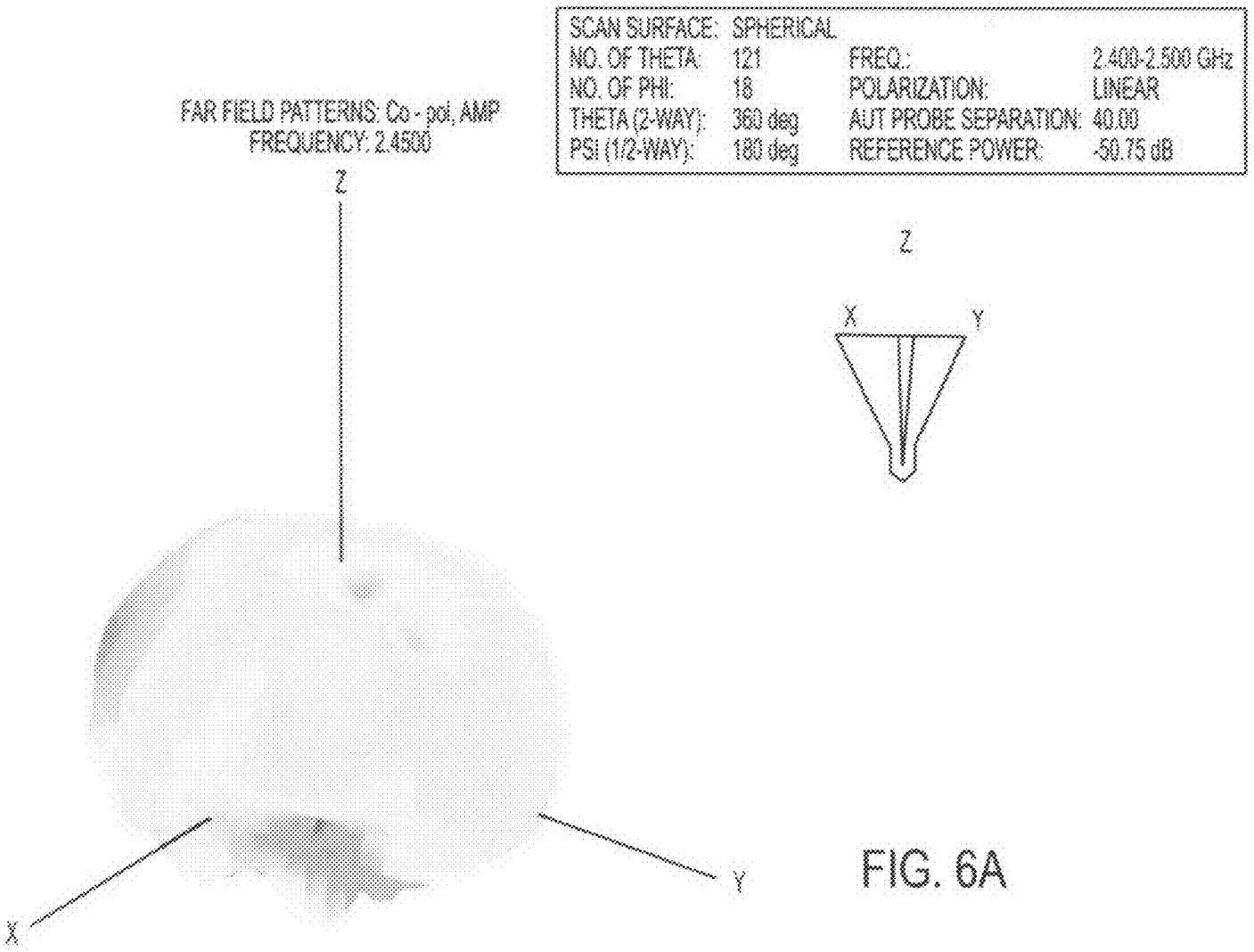
FIG. 6A is a three-dimensional graph depicting the antenna beam of a left side port, low frequency antenna operating at 2.45 GHz.
Figure 6B:
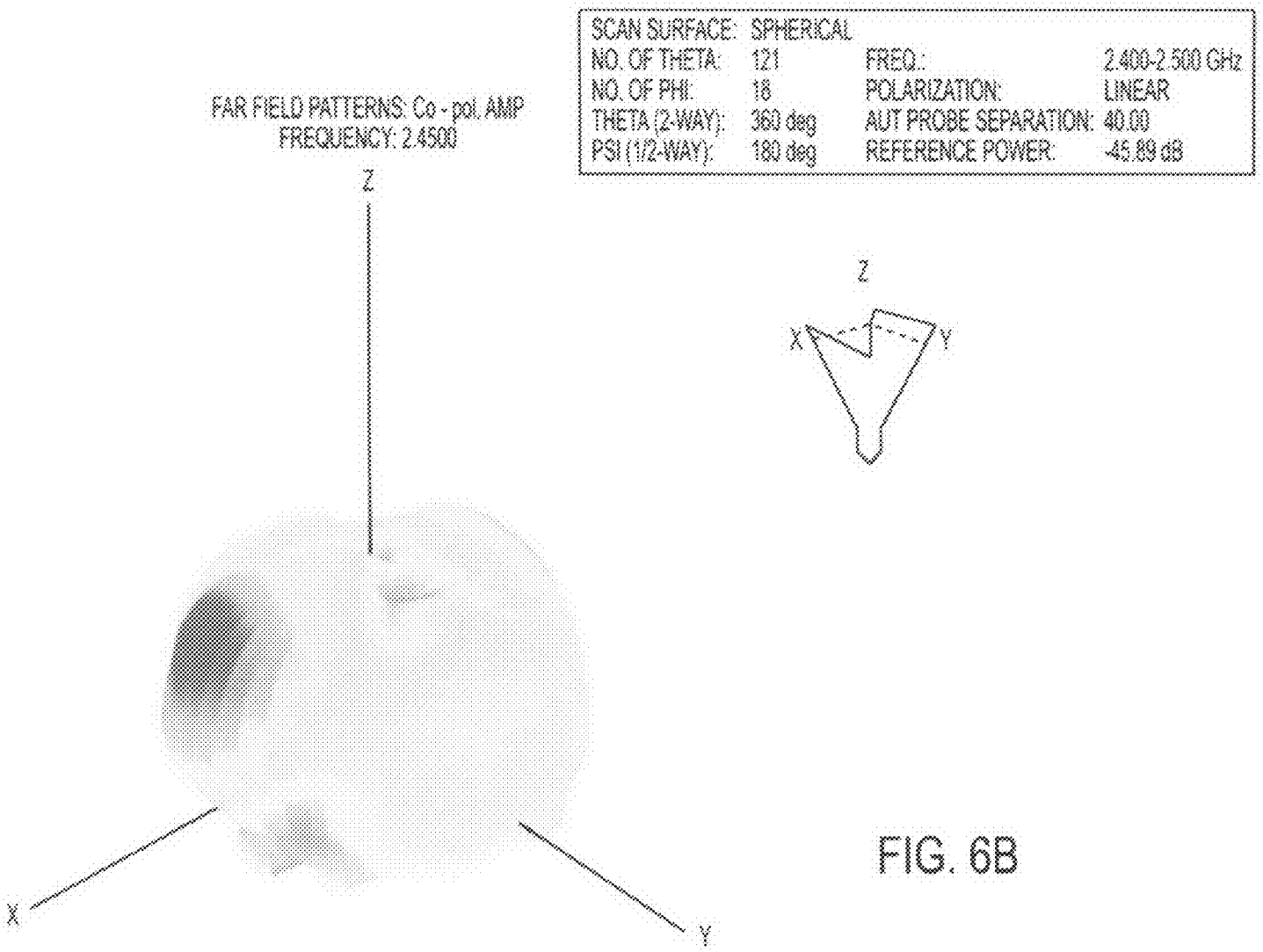
FIG. 6B is a three-dimensional graph depicting the antenna beam of a mid-port, low frequency antenna operating at 2.45 GHz.
Figure 6C:
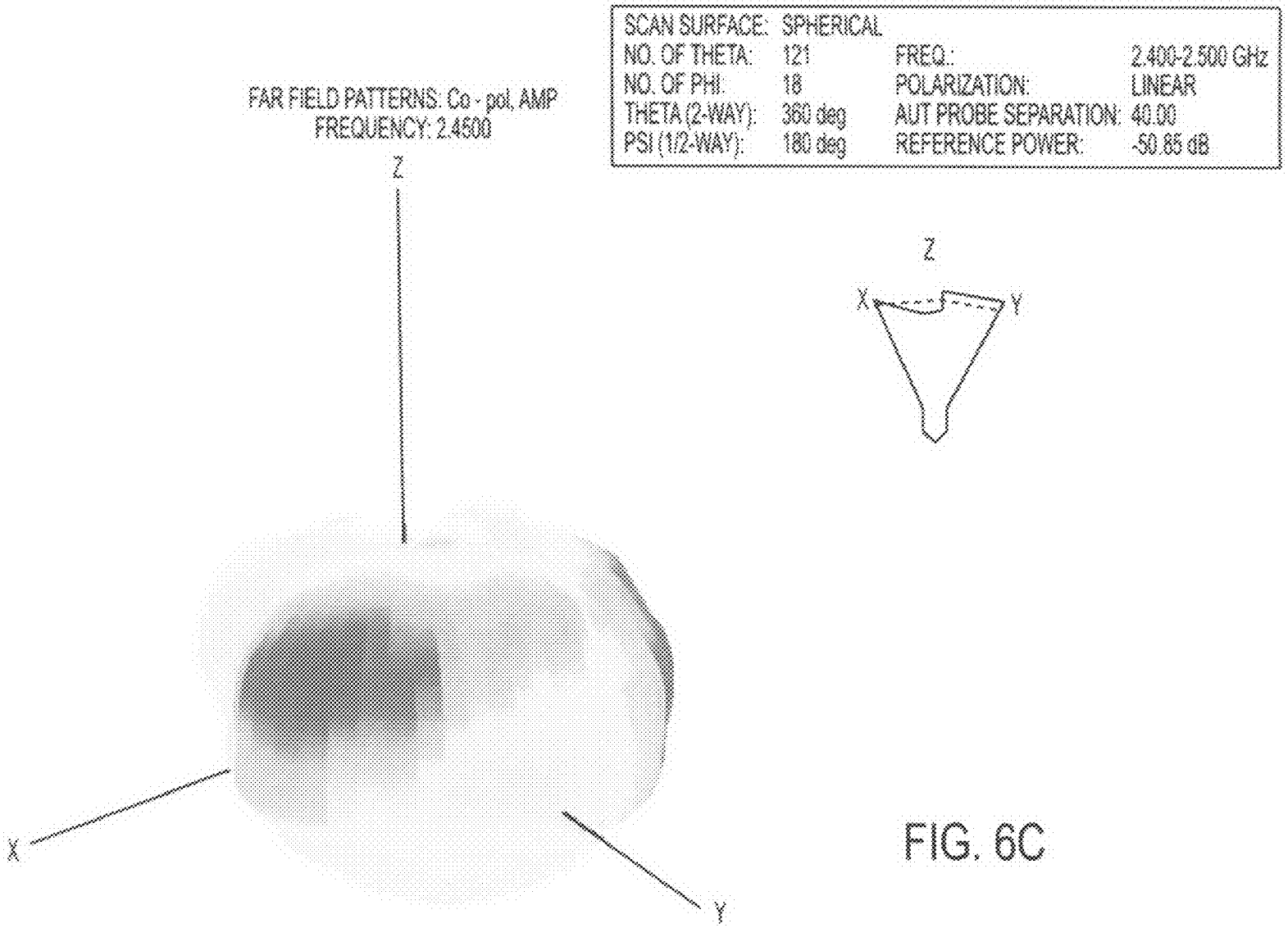
FIG. 6C is a three-dimensional graph depicting the antenna beam of a right side port, low frequency antenna operating at 2.45 GHz.
Figure 6D:
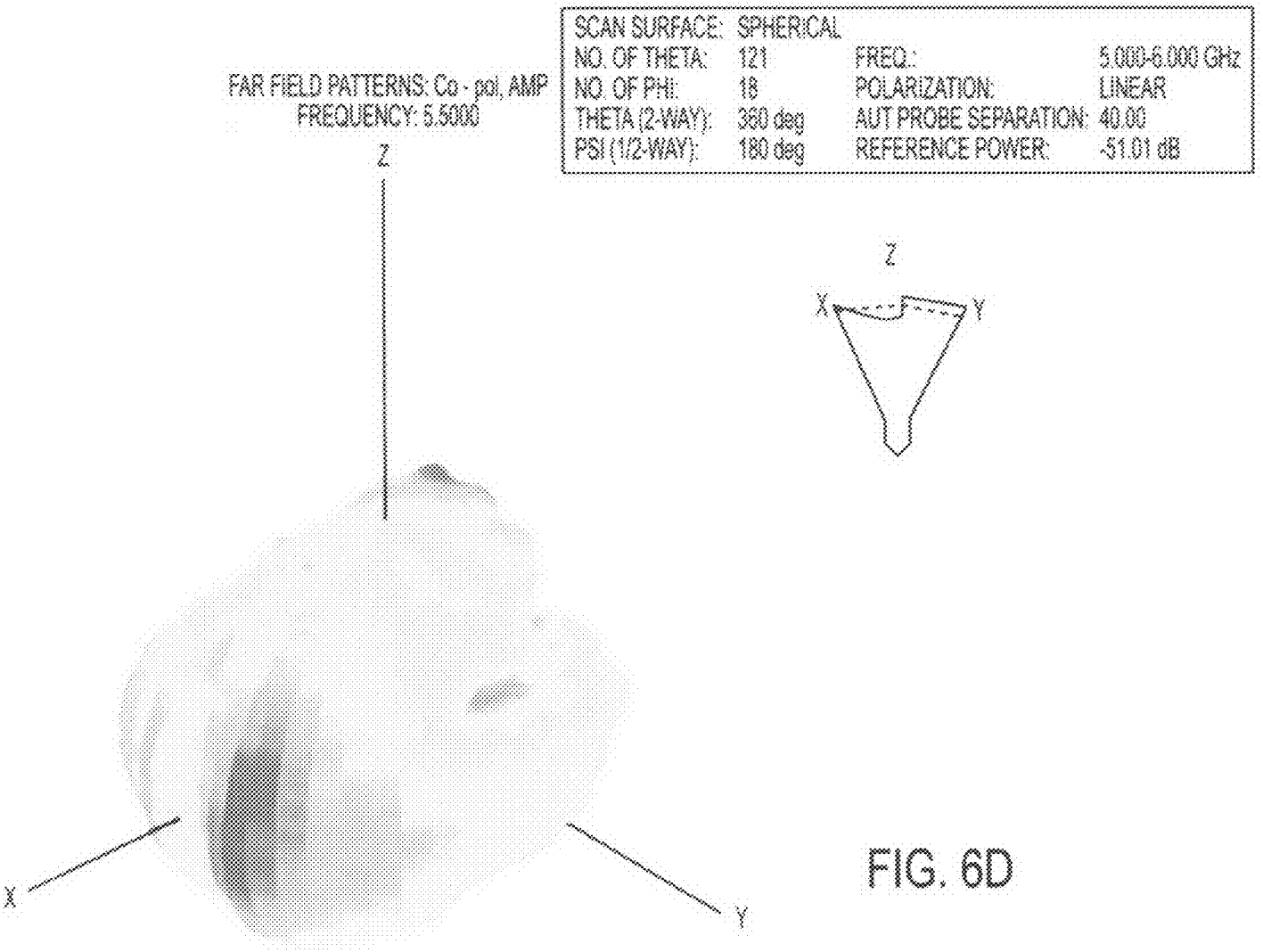
FIG. 6D is a three-dimensional graph depicting the antenna beam of a left side port, high frequency antenna operating at 5.5 GHz.
Figure 6E:
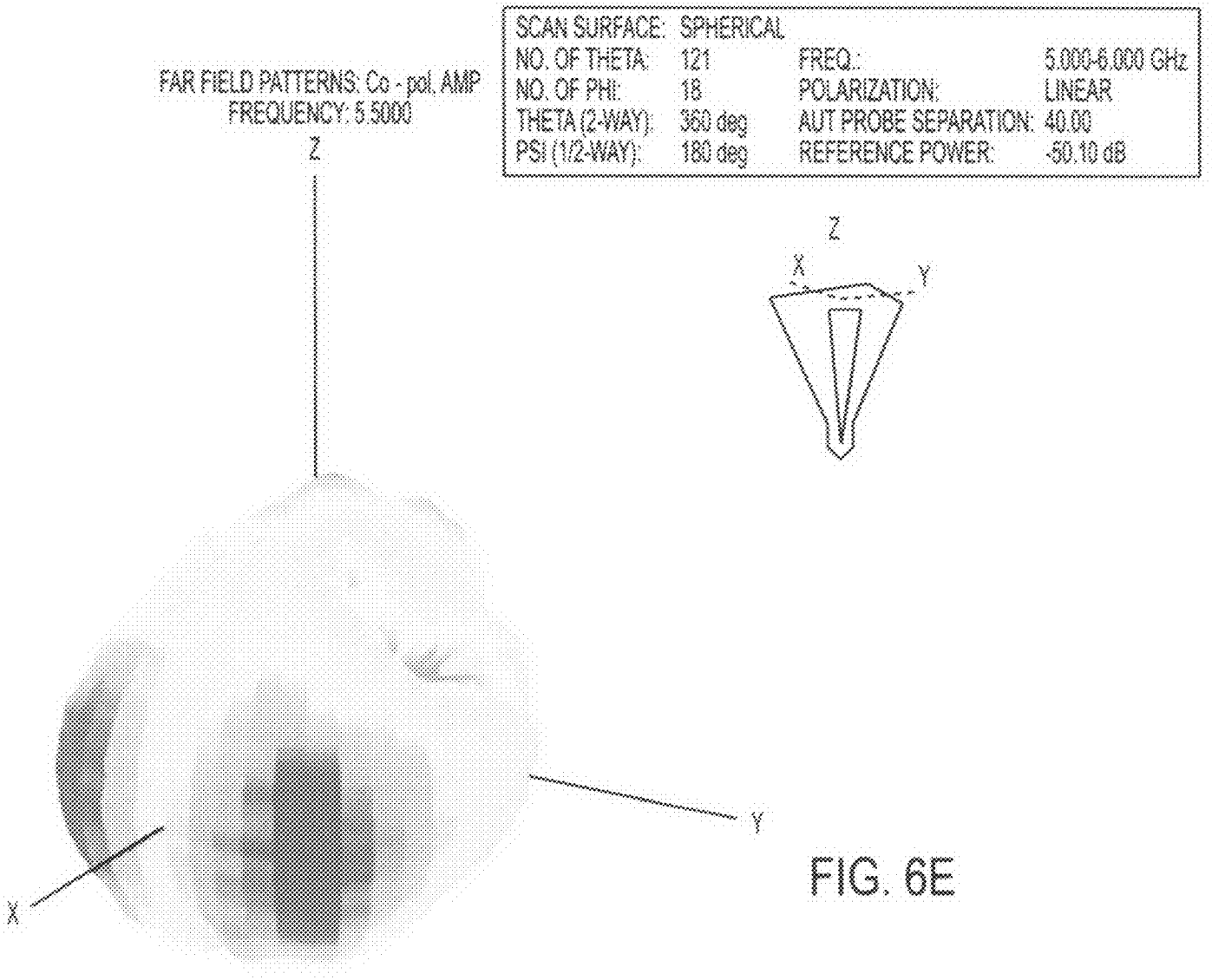
FIG. 6E is a three-dimensional graph depicting the antenna beam of a mid-port, high frequency antenna operating at 5.5 GHz.
Figure 6F:
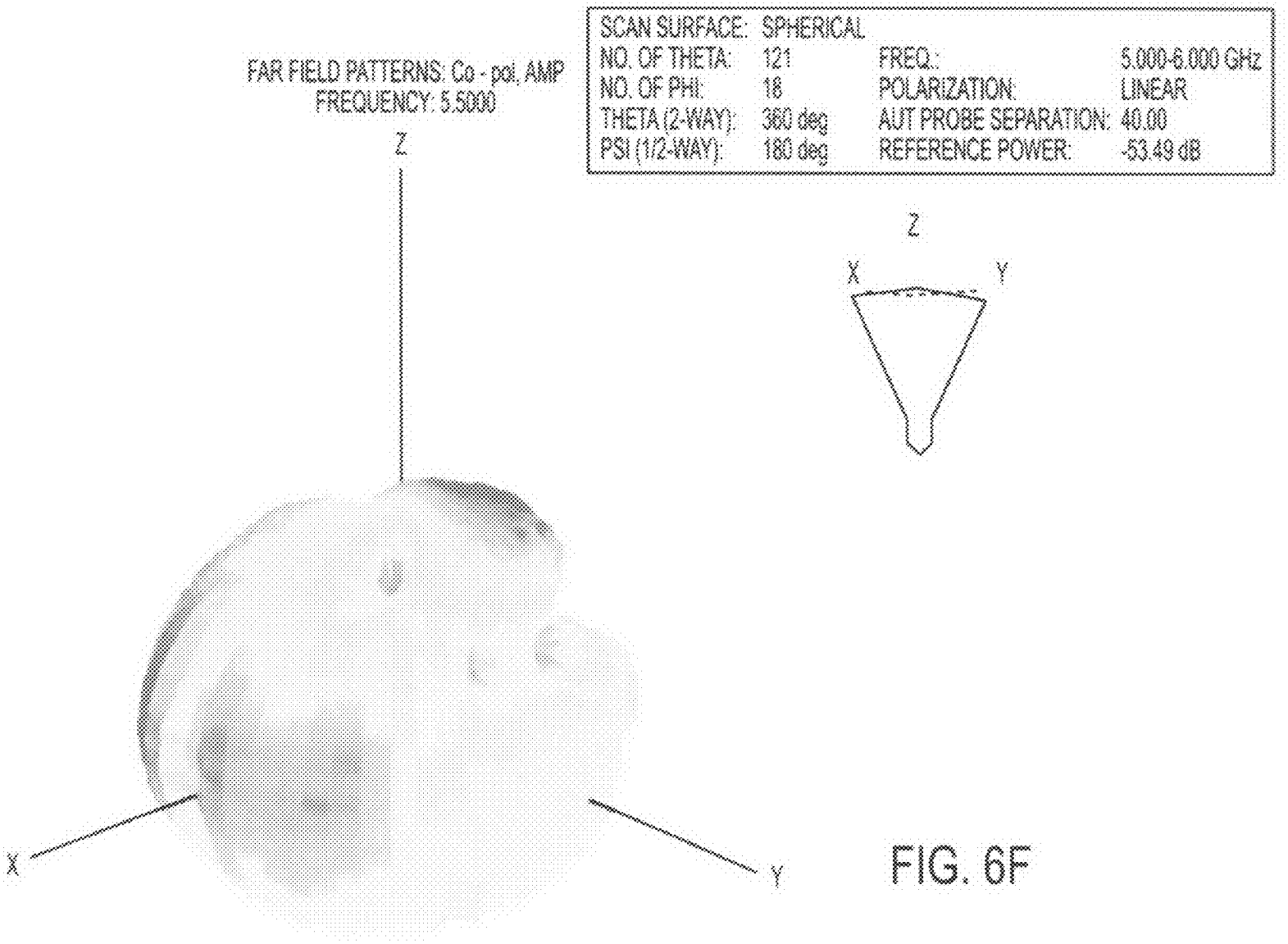
FIG. 6F is a three-dimensional graph depicting the antenna beam of a right side port, high frequency antenna operating at 5.5 GHz.

FIG. 5 is a schematic diagram of the channels on which the plurality of antennas 100 transmit in accordance with the present invention. For purposes of simplicity in representing the transmitted beams, FIG. 5 only shows the low frequency antennas 110, 115, and 120 transmitting beams, and the high frequency antennas 130, 135, and 140 receiving the transmitted beams. However, it is to be understood that the high frequency antennas 130, 135, and 140 can also transmit beams, and the low frequency antennas 110, 115, and 120 can also receive the transmitted beams. Further, it is to be understood that the low frequency antennas 110, 115, and 120 can receive beams transmitted from the low frequency antennas 110, 115, 120, and that the high frequency antennas 130, 135, and 140 can receive beams transmitted from the high frequency antennas 130, 135, and 140.

As seen in FIG. 5, antenna 110 can transmit a beam to antenna 130 on channel $h_{110\text{-}130}$, antenna 110 can transmit a beam to antenna 135 on channel $h_{110\text{-}135}$, and antenna 110 can transmit a beam to antenna 140 on channel $h_{110\text{-}140}$. Similarly, antenna 115 can transmit a beam to antenna 130 on channel $h_{115\text{-}130}$, antenna 115 can transmit a beam to antenna 130 on channel $h_{115\text{-}135}$, and antenna 115 can transmit a beam to antenna 140 on channel $h_{115\text{-}140}$. Antenna 120 can also transmit beams to antennas 130, 135, and 140 on beams $h_{120\text{-}130}$, $h_{120\text{-}135}$, and $h_{120\text{-}140}$, respectively.

As desired in MIMO systems, the beams transmitted from each of the antennas 110, 115, 120, 130, 135, and 140 can be wide. In exemplary embodiments of the present invention, antenna 110 operates at 2.45 GHz and is located opposite 130 on the base hub 150. Similarly, antenna 115 operates at 2.45 GHz and is located opposite antenna 135 on the base 150, and antenna 120 operates at 2.45 GHz and is located opposite antenna 140 on the base 150. In these exemplary embodiments of the present invention, antennas 130, 135, and 140 operate at 5.5 GHz. FIGS. 6A-6F are three-dimensional graphs depicting antenna beams from the antennas 110, 115, 120, 130, 135, and 140 according to these exemplary embodiments of the present invention.

To ensure isolation from and prevent interference between the low frequency neighboring antennas 110, 115, and 120, the antennas 110, 115, and 120 can include the antenna components, including the RF choke 24, as shown and described in connection with FIG. 2. Similarly, to ensure isolation from and prevent interference between the high frequency neighboring antennas 130, 135, and 140, the antennas 130, 135, and 140 can also include the antenna components, including the RF choke 24, as shown and described in connection with FIG. 2. Further, to prevent band-to-band coupling between the low frequency antennas 110, 115, and 120 and the high frequency antennas 130, 135, and 140, the high frequency antennas 130, 135, and 140 can include the antenna components, including the high pass circuit 32, as shown and described in connection with FIG. 3.

FIGS. 7A-7I are exemplary graphs showing the out of band isolation between the low frequency antennas 110, 115, and 120 and the high frequency antennas 130, 135, 140. In the exemplary graphs of FIGS. 7A-7I, the low frequency antennas 110, 115, and 120 are operating at approximately 2.4 GHz , and the high frequency antennas 130, 135, and 140 are operating at approximately 5.5 GHz.

Figure 7A:
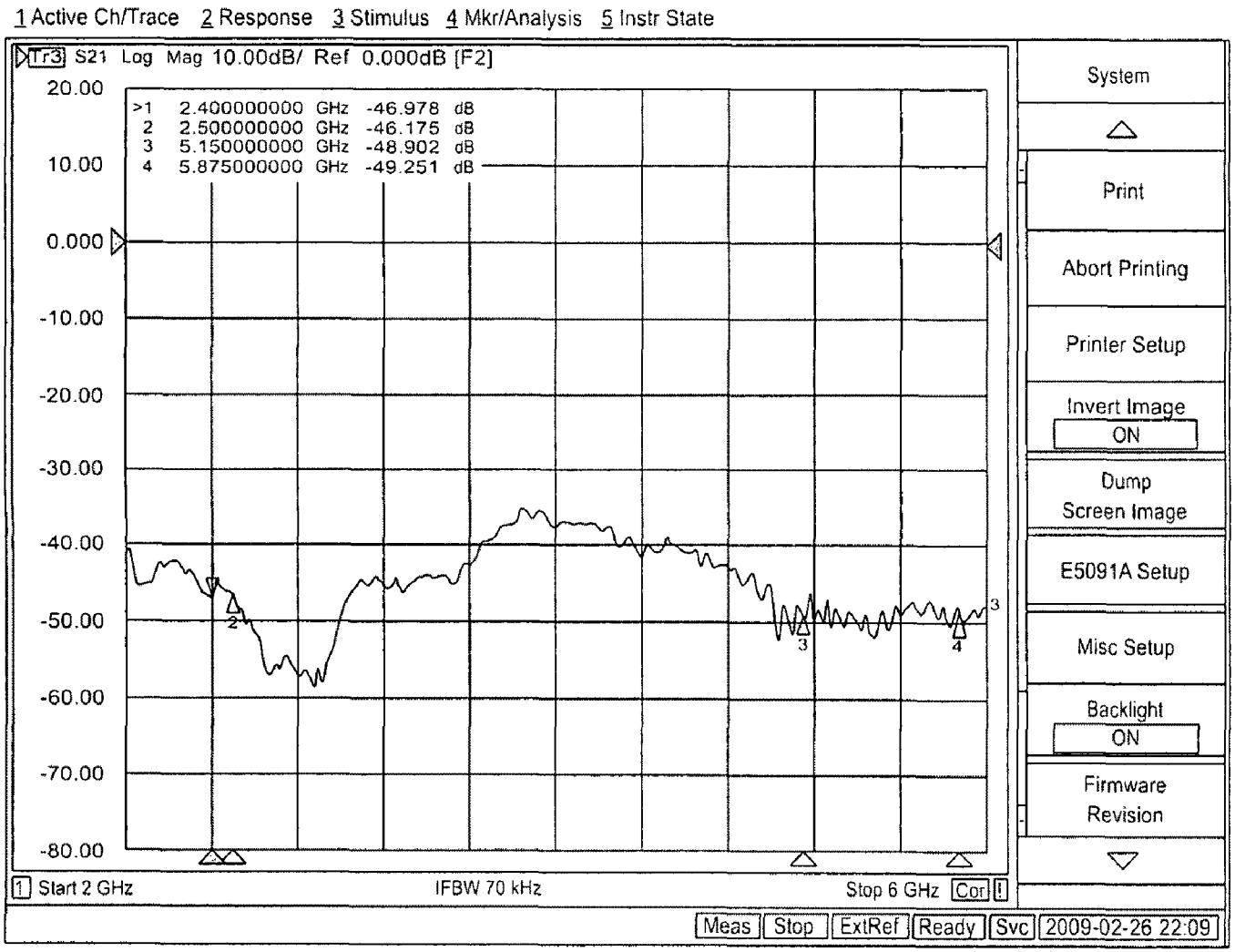
FIG. 7A is a graph showing out of band isolation between a left side port, low frequency antenna operating at 2.45 GHz and a left side port, high frequency antenna operating at 5.5 GHz.

FIG. 7A is a graph showing out of band isolation between a left side port, low frequency antenna 110 operating at 2.45 GHz and a left side port, high frequency antenna 130 operating at 5.5 GHz. As seen in FIG. 7A, at a low frequency of approximately 2.4 GHz, the antenna 110 achieves isolation of approximately −46.978 dB (see point 1), and at a low frequency of approximately 2.5 GHz, the antenna 110 achieves isolation of approximately −46.175 dB (see point 2). At a high frequency of approximately 5.15 GHz, the antenna 130 achieves isolation of approximately −48.902 dB (see point 3), and at a high frequency of approximately 5.875, the antenna 130 achieves isolation of approximately −49.251 dB (see point 4).

Figure 7B:
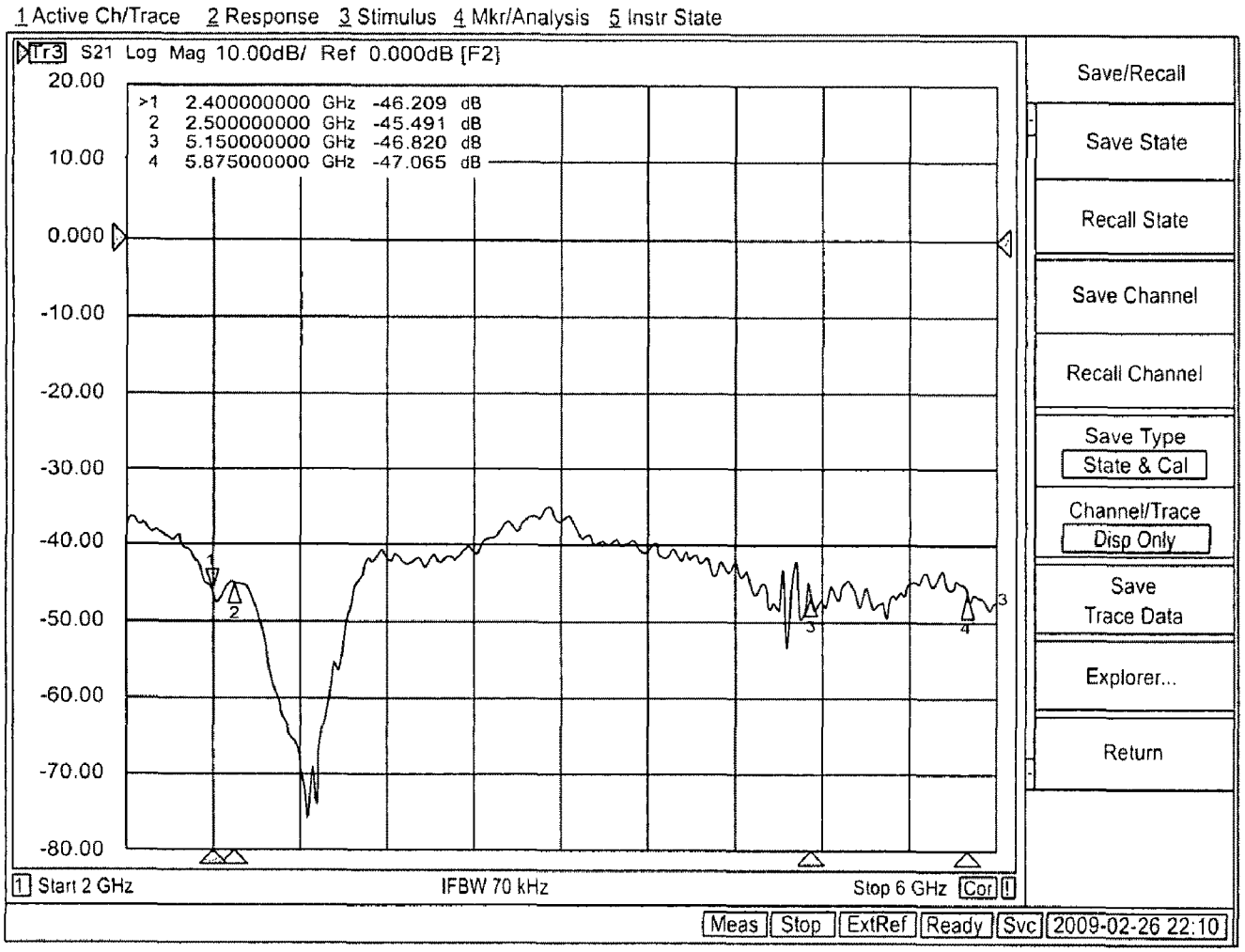
FIG. 7B is a graph showing out of band isolation between a left side port, low frequency antenna operating at 2.45 GHz and a mid-port, high frequency antenna operating at 5.5 GHz.

FIG. 7B is a graph showing out of band isolation between a left side port, low frequency antenna 110 operating at 2.45 GHz and a mid-port, high frequency antenna 135 operating at 5.5 GHz. As seen in FIG. 7B, at a low frequency of approximately 2.4 GHz, the antenna 110 achieves isolation of approximately −46.209 dB (see point 1), and at a low frequency of approximately 2.5 GHz, the antenna 110 achieves isolation of approximately −45.491 dB (see point 2). At a high frequency of approximately 5.15 GHz, the antenna 135 achieves isolation of approximately −46.820 dB (see point 3), and at a high frequency of approximately 5.875, the antenna 135 achieves isolation of approximately −47.065 dB (see point 4).

Figure 7C:
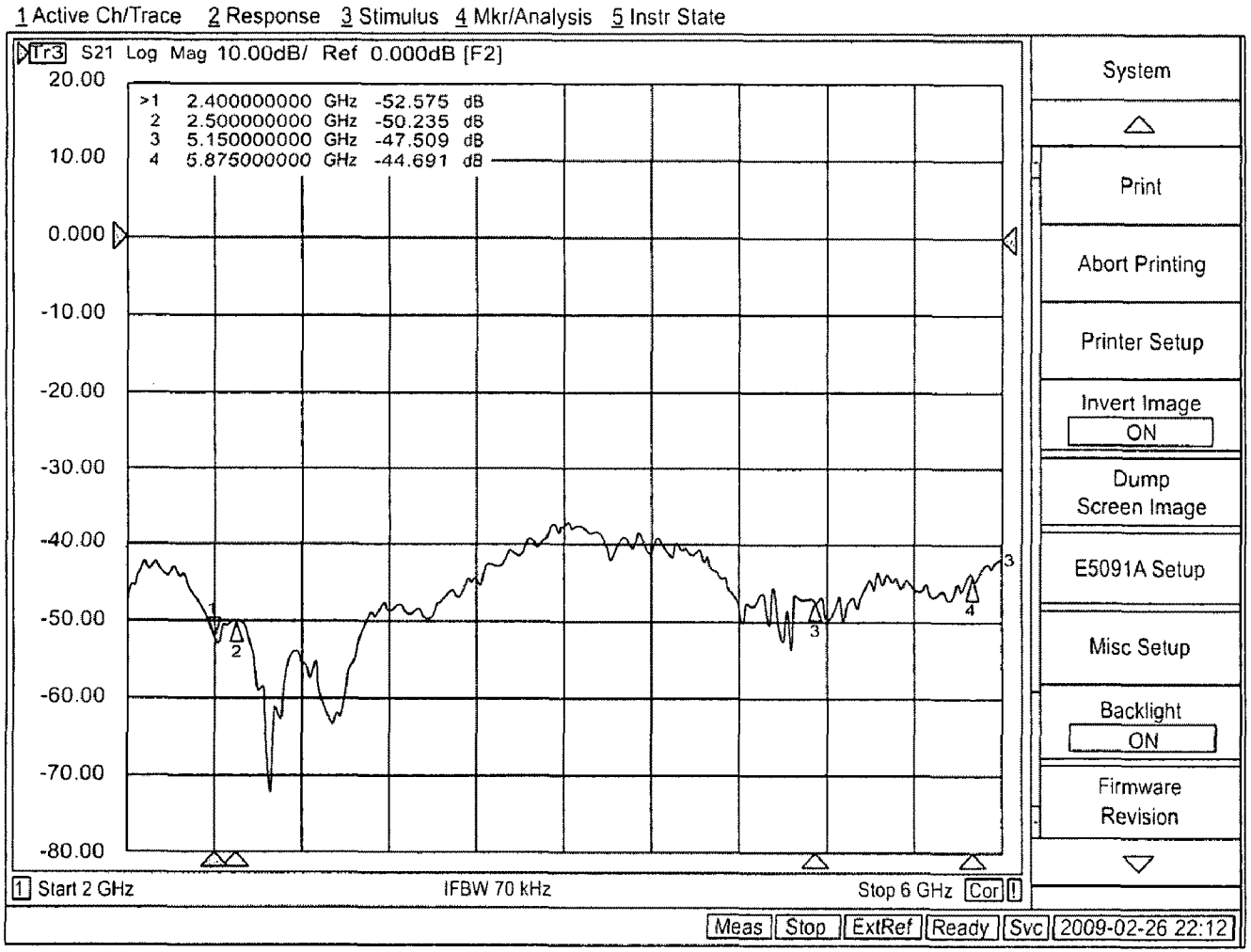
FIG. 7C is a graph showing out of band isolation between a left side port, low frequency antenna operating at 2.45 GHz and a right side port, high frequency antenna operating at 5.5 GHz.

FIG. 7C is a graph showing out of band isolation between a left side port, low frequency antenna 110 operating at 2.45 GHz and a right side port, high frequency antenna 140 operating at 5.5 GHz. As seen in FIG. 7C, at a low frequency of approximately 2.4 GHz, the antenna 110 achieves isolation of approximately −52.575 dB (see point 1), and at a low frequency of approximately 2.5 GHz, the antenna 110 achieves isolation of approximately −50.235 dB (see point 2). At a high frequency of approximately 5.15 GHz, the antenna 140 achieves isolation of approximately −47.509 dB (see point 3), and at a high frequency of approximately 5.875, the antenna 140 achieves isolation of approximately −44.691 dB (see point 4).

Figure 7D:
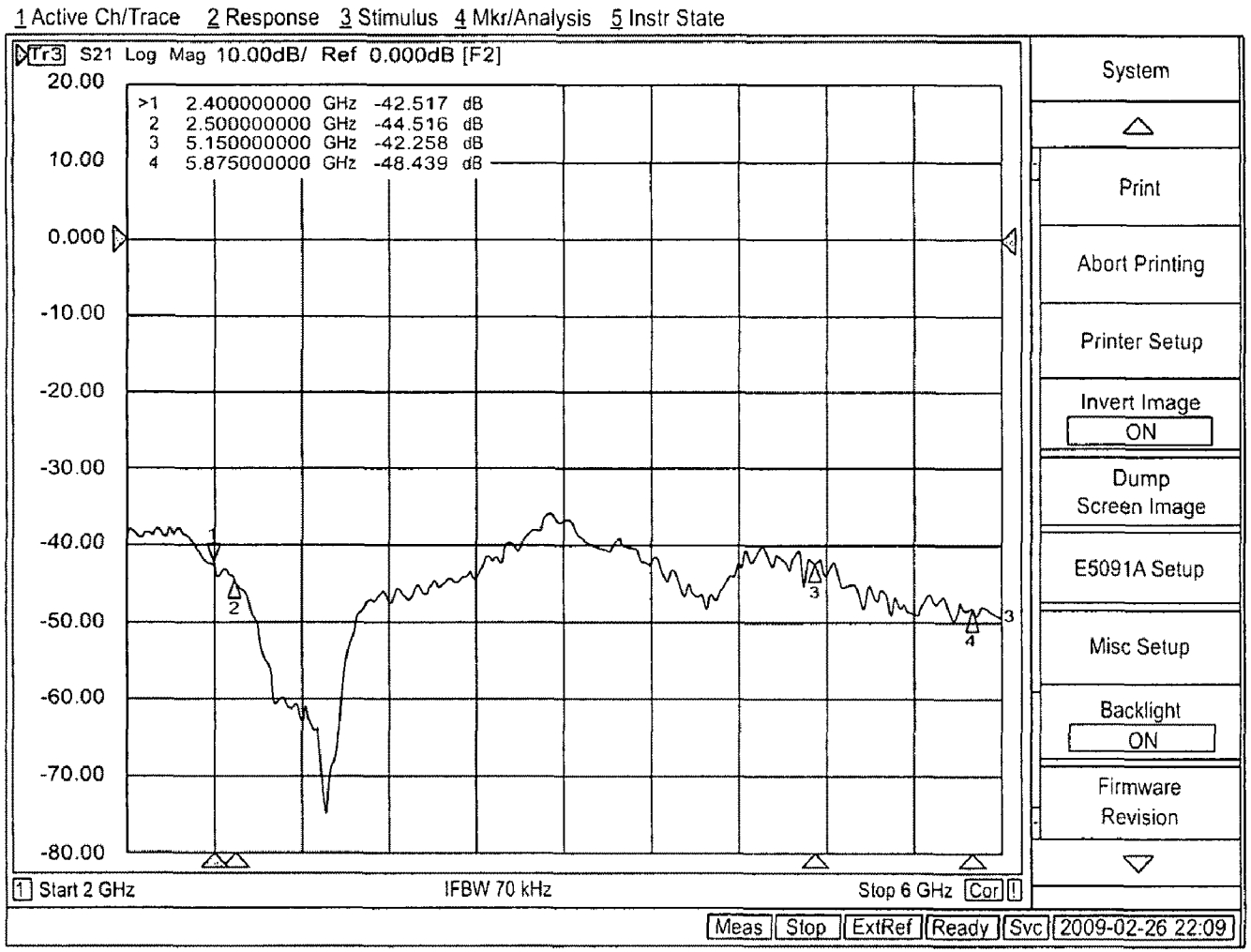
FIG. 7D is a graph showing out of band isolation between a mid-port, low frequency antenna operating at 2.45 GHz and a left side port, high frequency antenna operating at 5.5 GHz.

FIG. 7D is a graph showing out of band isolation between a mid-port, low frequency antenna 115 operating at 2.45 GHz and a left side port, high frequency antenna 130 operating at 5.5 GHz. As seen in FIG. 7D, at a low frequency of approximately 2.4 GHz, the antenna 115 achieves isolation of approximately −42.517 dB (see point 1), and at a low frequency of approximately 2.5 GHz, the antenna 115 achieves isolation of approximately −44.516 dB (see point 2). At a high frequency of approximately 5.15 GHz, the antenna 130 achieves isolation of approximately −42.258 dB (see point 3), and at a high frequency of approximately 5.875 GHz, the antenna 130 achieves isolation of approximately −48.439 dB (see point 4).

Figure 7E:
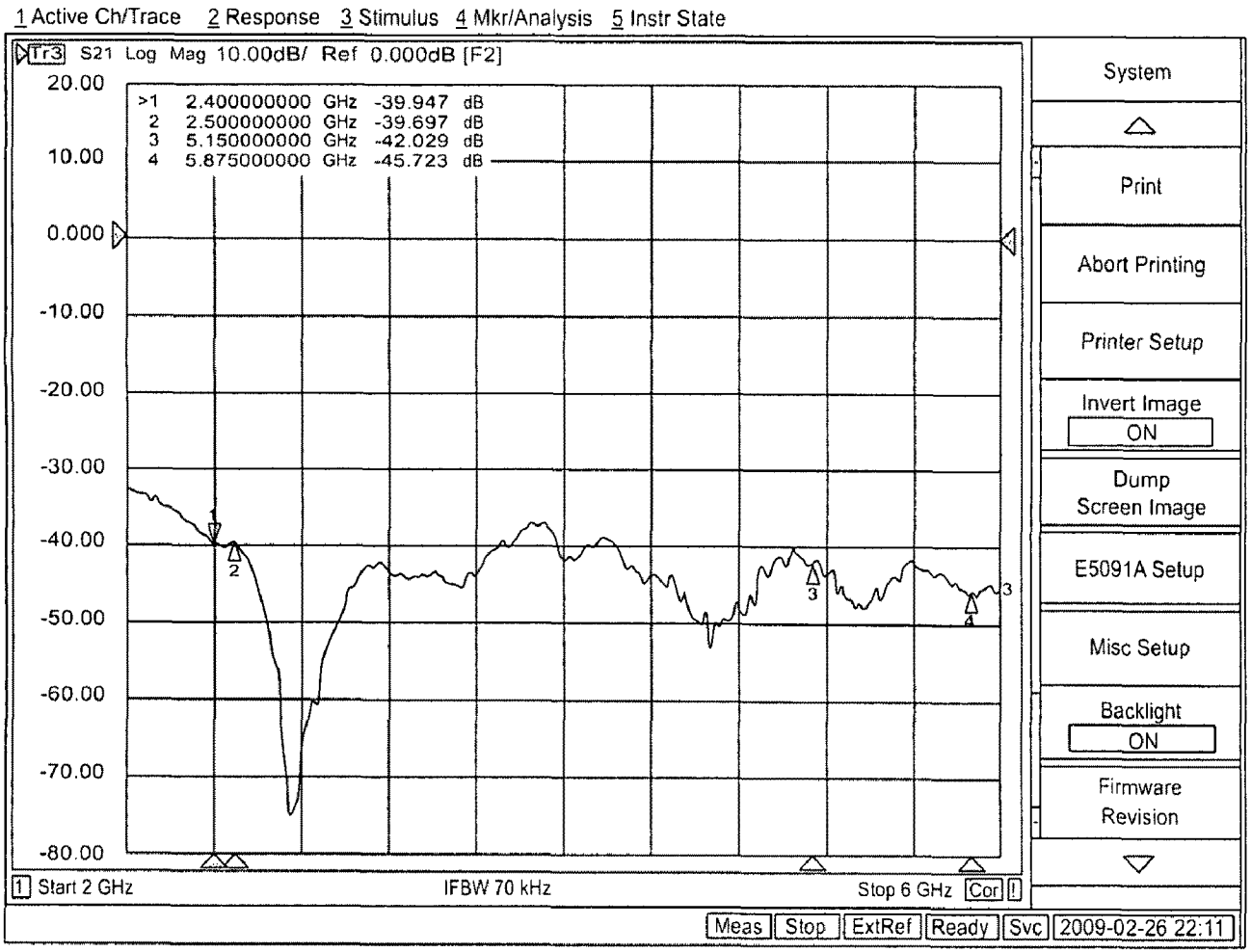
FIG. 7E is a graph showing out of band isolation between a mid-port, low frequency antenna operating at 2.45 GHz and a mid-port, high frequency antenna operating at 5.5 GHz.

FIG. 7E is a graph showing out of band isolation between a mid-port, low frequency antenna 115 operating at 2.45 GHz and a mid-port, high frequency antenna 135 operating at 5.5 GHz. As seen in FIG. 7E, at a low frequency of approximately 2.4 GHz, the antenna 115 achieves isolation of approximately −39.947 dB (see point 1), and at a low frequency of approximately 2.5 GHz, the antenna 115 achieves isolation of approximately −39.697 dB (see point 2). At a high frequency of approximately 5.15 GHz, the antenna 135 achieves isolation of approximately −42.029 dB (see point 3), and at a high frequency of approximately 5.875 GHz, the antenna 135 achieves isolation of approximately −45.723 dB (see point 4).

Figure 7F:
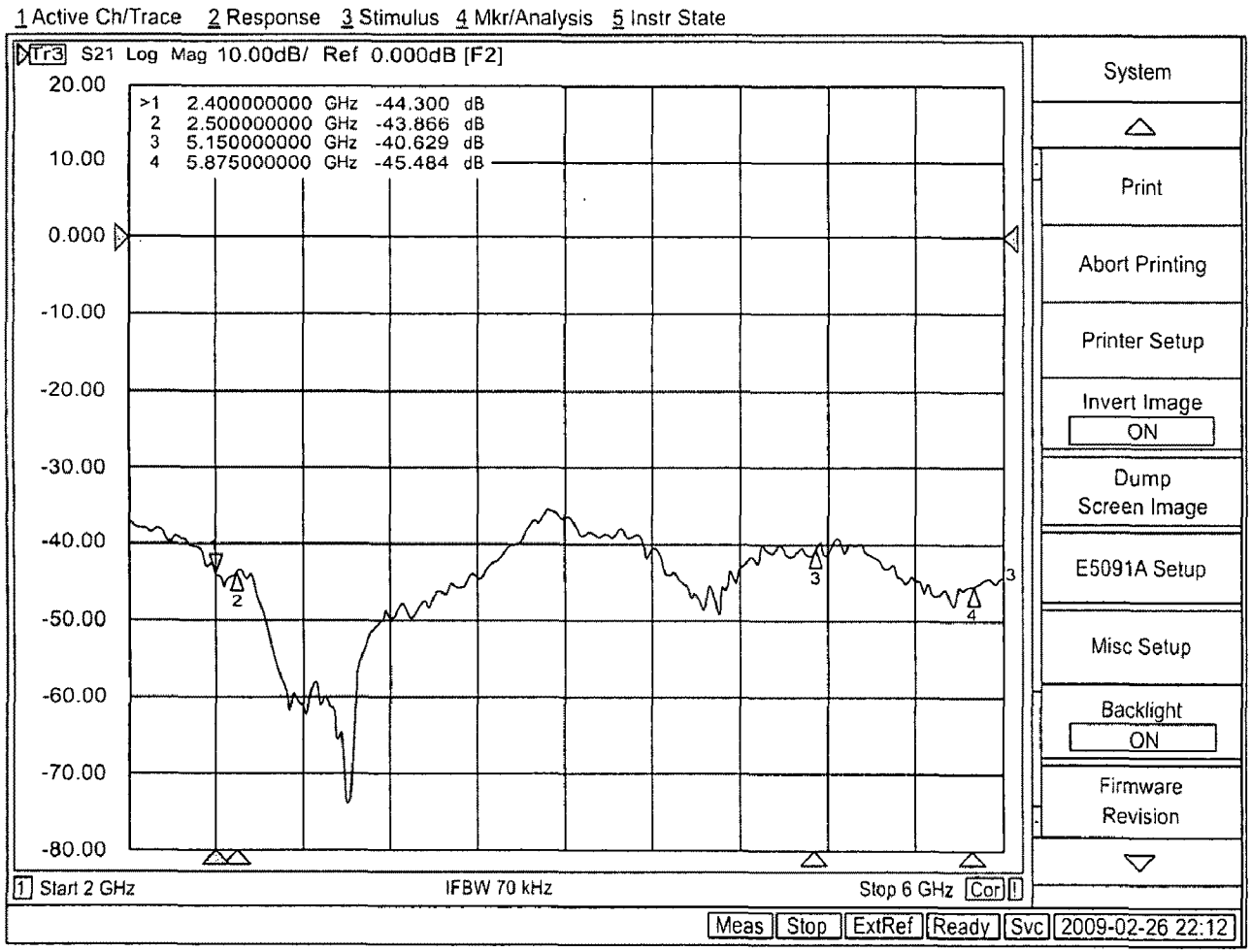
FIG. 7F is a graph showing out of band isolation between a mid-port, low frequency antenna operating at 2.45 GHz and a right side port, high frequency antenna operating at 5.5 GHz.

FIG. 7F is a graph showing out of band isolation between a mid-port, low frequency antenna 115 operating at 2.45 GHz and a right side port, high frequency antenna 140 operating at 5.5 GHz. As seen in FIG. 7F, at a low frequency of approximately 2.4 GHz, the antenna 115 achieves isolation of approximately −44.3 dB (see point 1), and at a low frequency of approximately 2.5 GHz, the antenna 115 achieves isolation of approximately −43.866 dB (see point 2). At a high frequency of approximately 5.15 GHz, the antenna 140 achieves isolation of approximately −40.629 dB (see point 3), and at a high frequency of approximately 5.875 GHz, the antenna 140 achieves isolation of approximately −45.484 dB (see point 4).

Figure 7G:
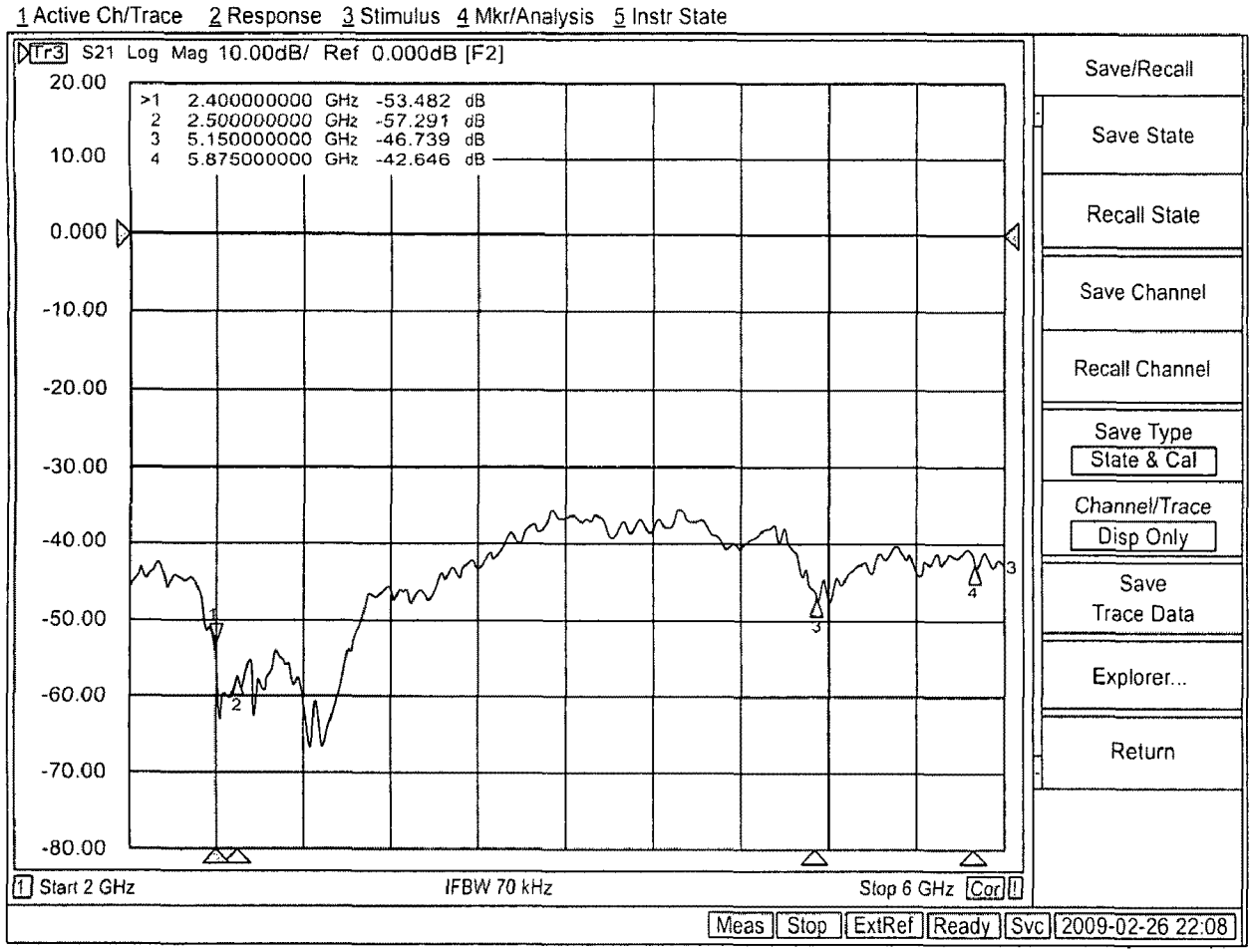
FIG. 7G is a graph showing out of band isolation between a right side port, low frequency antenna operating at 2.45 GHz and a left side port, high frequency antenna operating at 5.5 GHz.

FIG. 7G is a graph showing out of band isolation between a right side port, low frequency antenna 120 operating at 2.45 GHz and a left side port, high frequency antenna 130 operating at 5.5 GHz. As seen in FIG. 7G, at a low frequency of approximately 2.4 GHz, the antenna 120 achieves isolation of approximately −53.482 GHz (see point 1), and at a low frequency of approximately 2.5 GHz, the antenna 120 achieves isolation of approximately −57.291 dB (see point 2). At a high frequency of approximately 5.15 GHz, the antenna 130 achieves isolation of approximately −46.739 dB (see point 3), and at a high frequency of approximately 5.875 GHz, the antenna 130 achieves isolation of approximately −42.646 dB (see point 4).

Figure 7H:
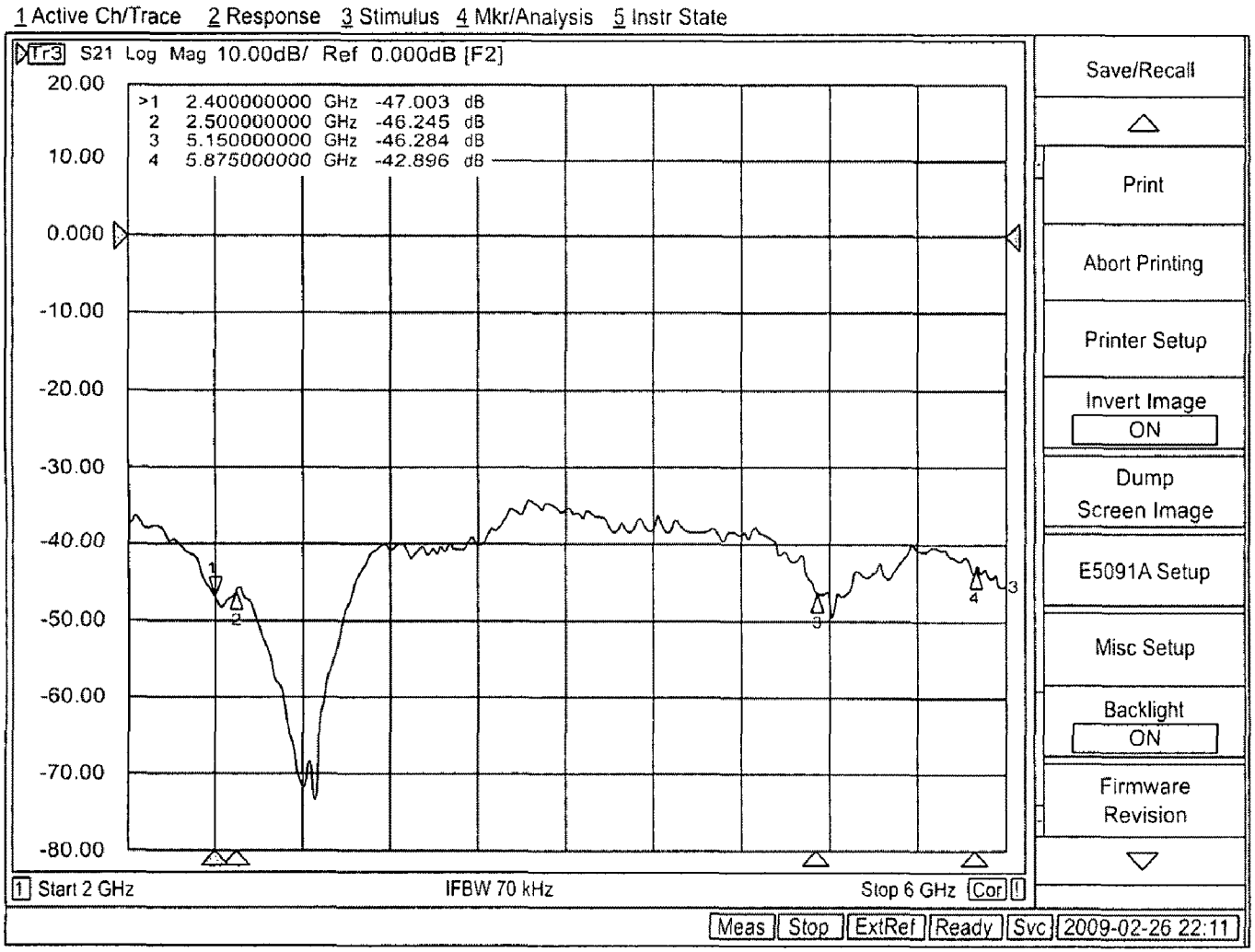
FIG. 7H is a graph showing out of band isolation between a right side port, low frequency antenna operating at 2.45 GHz and a mid-port, high frequency antenna operating at 5.5 GHz.

FIG. 7H is a graph showing out of band isolation between a right side port, low frequency antenna 120 operating at 2.45 GHz and a mid-port, high frequency antenna 135 operating at 5.5 GHz. As seen in FIG. 7H, at a low frequency of approximately 2.4 GHz, the antenna 120 achieves isolation of approximately −47.003 dB (see point 1), and at a low frequency of approximately 2.5 GHz, the antenna 120 achieves isolation of approximately −46.245 dB (see point 2). Ata high frequency of approximately 5.15 GHz, the antenna 135 achieves isolation of approximately −46.284 dB (see point 3), and at a high frequency of approximately 5.875 GHz, the antenna 135 achieves isolation of approximately −42.896 dB (see point 4).

Figure 7I:
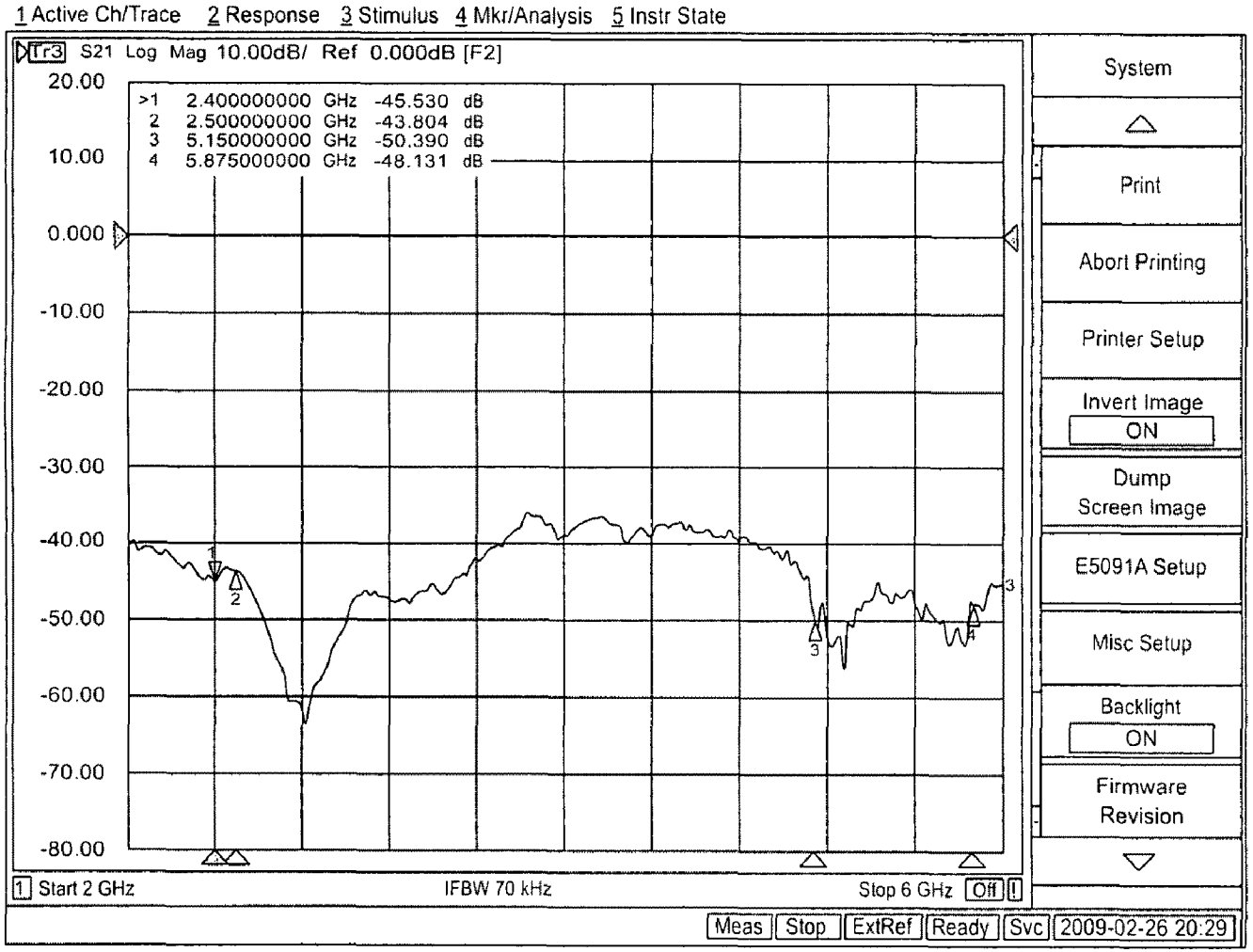
FIG. 7I is a graph showing out of band isolation between a right side port, low frequency antenna operating at 2.45 GHz and a right side port, high frequency antenna operating at 5.5 GHz.

FIG. 7I is a graph showing out of band isolation between a right side port, low frequency antenna 120 operating at 2.45 GHz and a right side port, high frequency antenna 140 operating at 5.5 GHz. As seen in FIG. 7I, at a low frequency of approximately 2.4 GHz, the antenna 120 achieves isolation of approximately −45.530 dB (see point 1), and at a low frequency of approximately 2.5 GHz, the antenna 120 achieves isolation of approximately −43.804 dB (see point 2). At a high frequency of approximately 5.15 GHz, the antenna 140 achieves isolation of approximately −50.390 dB (see point 3), and at a high frequency of approximately 5.875 GHz, the antenna 140 achieves isolation of approximately −48.131 dB (see point 4).

From the foregoing, it will be observed that numerous variations and modifications may be effected without departing from the spirit and scope of the invention. It is to be understood that no limitation with respect to the specific system or method illustrated herein is intended or should be inferred. It is, of course, intended to cover by the appended claims all such modifications as fall within the spirit and scope of the claims.

What is claimed is:

1. An antenna comprising:

an antenna base;

a connector pin extending from a top side and from a bottom side of the antenna base along a single, central vertical axis substantially perpendicular to the antenna base;

a connector body mounted on an electrical body, the connector body extending along first and second vertical axes substantially parallel to the connector pin; and an RF choke mounted on the electrical body, the RF choke extending along third and fourth vertical axes substantially parallel to the connector body, wherein a first distance between the antenna base and a distal end of the connector pin is substantially equal to a second distance between the antenna base and distal ends of the connector body, wherein a third distance between the antenna base and distal ends of the RF choke is less than both the first and second distances, and wherein the connector body provides a current to excite a radiator and cause the radiator to emit a main radiation beam, the main radiation beam scatters into a plurality of scatter beams, and the RF choke prevents reflections of the scatter beams from interfering with the main radiation beam.

2. The antenna of claim 1 further comprising a housing with an upper domed portion housing at least portions of the connector pin, the connector body, and the RF choke.

3. The antenna of claim 1 further comprising an insulation material disposed between the connector pin and the connector body.

4. The antenna of claim 1 wherein the antenna can both transmit a main radiation beam and receive a radiation beam from at least a second antenna.

5. The antenna of claim 4 wherein the RF choke prevents interference between the main beam radiation and the radiation beam from the second antenna.

6. The antenna of claim 1 operating at a frequency of approximately 2.4-2.5 GHz.

7. The antenna of claim 6 wherein isolation of from approximately −39 dB to approximately −58 dB of the main radiation beam is achieved.

8. The antenna of claim 1 operating at a frequency of approximately 5.15-5.875 GHz.

9. The antenna of claim 8 wherein isolation of from approximately −40 dB to approximately −51 dB of the main radiation beam is achieved.

10. An antenna comprising:

an antenna base;

a connector pin extending from a bottom side of the antenna base along a central vertical axis substantially perpendicular to the antenna base;

a high pass circuit deposited substantially directly on a top side of the antenna base;

a printed circuit board substrate extending from the top side of the antenna base; and a radiator deposited on the printed circuit board, wherein the high pass circuit passes signals having at least a predetermined high frequency for transmission by the radiator, and the high pass circuit blocks signals having a frequency below the predetermined high frequency from being transmitted by the radiator.

11. The antenna of claim 10 further comprising a housing with an upper domed portion housing at least portions of the connector pin, the high pass circuit, and the radiator.

12. The antenna of claim 10 wherein the radiator can both transmit a main radiation beam and receive a radiation beam from at least a second antenna.

13. The antenna of claim 12 wherein the main radiation beam is transmitted at least the predetermined high frequency and the radiation beam from the second antenna is received at below the predetermined high frequency.

14. The antenna of claim 13 wherein the high pass circuit prevents interference between the main beam radiation and the radiation beam from the second antenna.

15. The antenna of claim 10 wherein the predetermined high frequency is approximately 5 GHz.

16. The antenna of claim 10 operating at a frequency of approximately 5.15-5.875 GHz.

17. The antenna of claim 16 wherein isolation of from approximately −40 dB to approximately −51 dB of the main radiation beam is achieved.

18. An antenna comprising:

an antenna base;

a connector pin extending from a top side and from a bottom side of the antenna base along a single, central vertical axis substantially perpendicular to the antenna base;

a connector body mounted on an electrical body, the connector body extending along first and second vertical axes substantially parallel to the connector pin;

an RF choke mounted on the electrical body, the RF choke extending along third and fourth vertical axes substantially parallel to the connector body;

a high pass circuit deposited substantially directly on a top side of the antenna base;

a printed circuit board substrate extending from the top side of the antenna base; and a radiator deposited on the printed circuit board, wherein the connector body emits a main radiation beam, the main radiation beam scatters into a plurality of scatter beams, and the RF choke prevents reflections of the scatter beams from interfering with the main radiation beam, and wherein the high pass circuit passes signals having at least a predetermined high frequency, and the high pass circuit blocks signals having a frequency below the predetermined high frequency.

19. The antenna of claim 18 operating at a frequency of approximately 5.15-5.875 GHz.

20. The antenna of claim 19 wherein isolation of from approximately −40 dB to approximately −51 dB of the main radiation beam is achieved.

* * * * *